US008689862B2

(12) United States Patent
Talgø et al.

(10) Patent No.: US 8,689,862 B2
(45) Date of Patent: Apr. 8, 2014

(54) TUBE/PIPE SPOOLING DEVICE

(75) Inventors: Morten Talgø, Sandnes (NO); Øystein Skjæveland, Hafrsfjord (NO)

(73) Assignee: C6 Technologies AS, Stavanger (NO)

( * ) Notice: Subject to any disclaimer, the term of this patent is extended or adjusted under 35 U.S.C. 154(b) by 212 days.

(21) Appl. No.: 13/058,794

(22) PCT Filed: Aug. 11, 2009

(86) PCT No.: PCT/NO2009/000281
§ 371 (c)(1),
(2), (4) Date: Apr. 27, 2011

(87) PCT Pub. No.: WO2010/019047
PCT Pub. Date: Feb. 18, 2010

(65) Prior Publication Data

US 2011/0315804 A1 Dec. 29, 2011

(30) Foreign Application Priority Data

Aug. 13, 2008 (NO) ..... 20083510

(51) Int. Cl.
*E21B 19/22* (2006.01)

(52) U.S. Cl.
USPC ..... 166/77.1; 166/77.2

(58) Field of Classification Search
USPC ..... 166/77.1, 77.2
See application file for complete search history.

(56) References Cited

U.S. PATENT DOCUMENTS

| | | | | |
|---|---|---|---|---|
| 2,989,980 | A | 6/1961 | Cullen et al. | |
| 3,254,851 | A | 6/1966 | Caperton | |
| 3,373,818 | A | 3/1968 | Rike et al. | |
| 3,504,866 | A | 4/1970 | Palynchuk et al. | |
| 4,646,985 | A | 3/1987 | Goyau et al. | |
| 4,743,175 | A | 5/1988 | Gilmore | |
| 5,289,845 | A | 3/1994 | Sipos et al. | |
| 6,116,345 | A | 9/2000 | Fontana et al. | |
| 6,527,215 | B1 | 3/2003 | Cain et al. | |
| 7,708,058 | B1 * | 5/2010 | Gipson | 166/77.2 |

FOREIGN PATENT DOCUMENTS

| | | |
|---|---|---|
| FR | 2887535 | 6/2005 |
| GB | 2275041 | 8/1994 |
| GB | 2294674 | 8/1996 |
| WO | 9742394 | 11/1997 |

OTHER PUBLICATIONS

International Search Report, pp. 1-3.
Norwegian Search Report, One page.

* cited by examiner

*Primary Examiner* — Sang Kim
(74) *Attorney, Agent, or Firm* — Samuel M. Freund; Cochran Freund & Young LLC

(57) ABSTRACT

A reel assembly for supplying a continuous composite tubing of a type used in oilfield operations, which reel assembly comprises a stand onto which a spool of continuous composite tubing is lowered and a drive coupling for transmitting rotational force from the stand to the spool. A removable cage is connected with the stand. The continuous composite tubing is arranged around the outer periphery of the spool, in a U-formed housing.

7 Claims, 3 Drawing Sheets

TUBE/PIPE SPOOLING DEVICE

TECHNICAL FIELD

The present invention relates to a device for handling an elastically flexible and compression resistant elongated element, and more particularly the present invention relates to transportable reels that have a capacity to hold and support a cable or pipe made of composite.

BACKGROUND OF THE INVENTION

During the lifetime of an oil or gas well different operations are performed in order to monitor the state of the well, to carry out measurements, to stimulate or treat the well, to replace various equipment or tools, or to carry out other necessary work. Different downhole equipment is then attached to a continuous tubing and run into and retrieved from the well.

When performing the above mentioned interventions in a well, many types of equipment are used: a coiled tubing, wire or possibly just a string (so-called "slick-line"). The various types of intervention equipment for wells have to be selected depending on the complexity of the task to be performed.

Coiled tubing is used during larger work and, in particular, when there is a need of performing circulation, as during stimulation of the well (chemical treatment or fracturing). The disadvantage is that the intervention type is very expensive as the use of a drilling rig is required.

Wires are used when there is no need of circulation, e.g. during measurements. Wires may also be provided with conductors for power supply and signal transmission. Often, wires are used for the intervention due to their large rupture strength and, thereby, may be used when the tool is relatively heavy. Because of the spaces between the wire components, the disadvantage of the wire is that a particular injector for grease (so-called "grease injector head") must be used, by which grease under pressure is continuously injected to seal around the wire. Even if the grease provides relatively low friction and enables lowering of the tool by its own weight, this method requires large investments for equipment and materials.

In some cases, when the tool to be lowered is not too heavy, for example during sample collecting, a string may be used. When such a thin string is used, the grease injector head mentioned above may be replaced by more simple sealing means, for example a so-called stuffing box. The stuffing box comprises a tubular sleeve of rubber or the like. The cable is tightly enclosed by the tubular sleeve in an extent preventing discharges but simultaneously without making the friction between the string and the sleeve too large. This is an inexpensive method of well intervention.

However, a disadvantage of the previous stuffing box types is that the providing of such a sealing around the string may result in a too large friction. Another disadvantage is that such strings have a limited strength, and also a limited usability as power supply or signal transmission means are not included.

The continuous tubing is usually wound on a large spool, where the continuous tubing includes small diameter cylindrical tubing made of metal or composites which have a relatively thin cross sectional thickness. Such tubing (a cable or pipe) is typically more flexible and lighter than a conventional drill string. It is much faster to run into and out of a well bore than conventional joined straight pipe since there is no need to connect or disconnect short segments of a straight pipe.

A cable or pipe reel assembly usually includes a stand for supporting a spool on which the cable or pipe is stored, a drive system for rotating the reel and creating back-tension during operation of the reel, and a "level winding" system that guides the cable or pipe as it is being unwound from and wound onto the spool. The level winding system moves the cable or pipe laterally across the reel so that the cable or pipe is laid across the reel in a neat and organized fashion. The cable or pipe reel assembly must rotate the spool to feed the cable or pipe to and from the injector and well bore. The cable or pipe reel assembly must also tension the cable or pipe by always pulling against the injector during normal operation. The injector must pull against the tension to take the cable or pipe from the cable or pipe reel, and the reel must have sufficient pulling force and speed to keep up with the injector and maintain tension on the cable or pipe as the cable or pipe is being pulled out of the bore by the injector. The tension on the cable or pipe must always be maintained. The tension must also be sufficient to wind the cable or pipe properly on the spool and to keep the cable or pipe wound on the spool. Consequently, a cable or pipe reel assembly is subjected to substantial forces and loads.

There exist cable or pipe reel stands for receiving common and ordinary shipping spools for use as working reels. These cable or pipe reel assemblies require inserting a shaft through the center of the spool, and inserting a pair of driving knobs, mounted to a drive plate on the stand, into the side of the spool to provide the connection for the drive system. As a consequence, this type of reel stand has several problems. First, the reel stand either has to be separable into two halves so that the sides of the stand can be moved laterally away from each other, or has to have sides of the stand capable of being swung outwardly, in order to allow the shipping spool of cable or pipe to be loaded on the stand. Secondly, the spool has to be carefully aligned with the drive system on the stand. Spools wound with cable or pipe are very large and heavy, where the weight may vary from 10000 to 20000 kg on average. They are cumbersome and difficult to manoeuvre. Consequently, aligning a spool and the drive system on a rocking ship or in high winds is a difficult task.

Third, as previously mentioned, standard and ordinary shipping spools are not built to handle the substantial loads encountered by a typical working spool.

Such continuous cable or pipe has been used successfully in the oil and gas industry for many years. The development of new technology has expanded the role of coiled tubing in completion, workover, drilling and production applications. The vast majority of technology and applications have focused on metallic coiled tubing. Although uses for metallic coiled tubular have significantly increased in the past twenty years, limitations are experienced on occasion with metallic tubular, including tensile strength limitations due to string weight and corrosion susceptibility from inhospitable conditions.

Technology advancements in non-metallic, composite based cable and pipe products have facilitated solutions to many of the limitations encountered with metallic coiled tubular.

Composite tubing is commonly composed of a combined resinous-fibrous outer tube concentrically encompassing a plastic inner tube, with the inner tube substantially providing the desired strength and protective properties. When manufactured, the inner tube commonly becomes integrally fixed to the outer tube. As compared to steel tubular of identical size, composite tubular tends to have lower weight, superior burst properties, improved flow coefficients and increased fatigue resistance, while steel tends to exhibit more favorable collapse, compressive and tensile properties. Thus, in certain applications, composite tubular is a direct alternative to steel while in other applications composites are the highly preferred option.

However, the composite tubing is stiffer than conventional steel tubing and therefore also more difficult to handle and/or manipulate, store and transport, which gives rise to the need for a reel assembly which can support these types of continuous composite tubing.

GB 2.294.674 describes a device for handling a rod made from a resiliently flexible and compression-resistant composite material, where the device comprises a reel on which the rod is wound in an elastic state, means for retaining the rod pressed against the barrel of the reel and means for driving said reel in rotation. The retaining means has at least one roller whose axis is parallel to the axis of the reel and of width essentially equal to the width of the barrel and spring means for applying the roller against the rod wound on the barrel of the reel.

THE OBJECTS OF THE INVENTION

According to the present invention a device for handling an elastically flexible and compression resistant elongated element is provided, where the device holds and supports a continuous composite cable or pipe, for instance a composite rod, composite re-enforced copper cable, composite coiled tubing and composite re-enforced fiber optic measurement cable.

A further object of the present invention is to provide a reel assembly that will simplify the handling or treatment of such a stiff and relatively unwieldy elongated element.

Yet another object of the present invention is to provide a reel assembly that without adaption can be transported with ordinary vehicles, containers or vessels.

These objects are achieved with a system as indicated in the following independent claim where further embodiments and features of the invention will be apparent from dependent claims and the description below.

SUMMARY OF THE INVENTION

The present invention relates to a device for handling and supporting a continuous elongated element of a type that is used in oilfield operations. This elongated element may for instance be a composite tubing, to which composite tubing downhole equipment or tools are attached, whereby the equipment and/or tool can be run into and retrieved from an oil or gas well. The device includes a reel assembly for supporting the continuous composite tubing utilized in oilfield service operations, where the reel assembly comprises a portable stand. A spool of continuous composite tubing is supported on the stand by a central support member, the support member being disposed to rotate with the spool. A drive unit will through a drive coupling transmit rotational power from the stand to the spool, in order to unwind or wind the continuous composite cable on the spool.

Preferably the drive unit is provided with a gear arrangement.

In one preferred embodiment of the present invention cable support devices are connected to the central support member. The cable support devices comprise one or more arms, where the arms through their ends are connected to the central support member and gooseneck, respectively. The gooseneck may be arranged rotatably around the arm connection. Furthermore, the gooseneck may be provided with a plurality of rollers.

The cable support devices may be controllable in the radial direction of the spool, as this will entail that the goosenecks may exert a pressure or load against the continuous composite tubing.

In order to be able to control the winding and unwinding of the continuous composite cable, the reel assembly also comprises a tubing guidance device mounted to the central support member. By controlling the tubing guidance device, the composite tubing may be laid across the cable spool in neat and organized fashion.

As the continuous composite cable due to its stiff nature in a wound state will try to resume its straight position, a U-formed housing is arranged around the outer periphery of the spool. The U-formed housing may be manufactured from three sheets or plates which are connected to each other in an appropriate way. A back plate will extends along the axis of the spool 1, where two flanges are arranged perpendicularly on the back wall, thereby forming the U-shaped housing. The U-form is preferably facing inwards towards the central support member.

The reel assembly also comprises one or more swivel joint couplings, where these couplings are used to connect the continuous composite tubing to a fluid source and/or drain. How this is done will be obvious for a skilled person in the art.

According to the present invention the reel assembly may comprise a protective structure, where the protective structure is a cage or frame. The stand and the spool are then arranged within the protective structure. This will ease the transport of the spool, and it will also protect the spool against outer influence.

The protective cage or frame may also be arranged to be removable, where the stand then may be mounted to a pair of skids, where this arrangement will ease the handling and operation of the reel assembly.

In order to protect the continuous composite tubing during the running of the composite tubing into or out of an oil or gas well, a protection tube is mounted to the protective structure, where the protection tube then extends from the protective structure and over a guidance device and to an injector device.

The guiding device may for instance be a gooseneck.

The protection tube may be manufactured from a composite material; it may further be a whole tube or it may also be provided with a slit extending over the entire length of the protection tube.

The reel may also comprise one or more hydraulic cylinders, where the hydraulic cylinders are used to connect the spool to the cage or frame. By controlling the position of the hydraulic cylinders, the spool can be moved relatively to the cage or frame.

It should be understood that composite tubing may be a composite rod, composite re-enforced copper cable with/without peek isolation, composite coiled tubing, composite re-enforced fiber optic measurement cable etc.

BRIEF DESCRIPTION OF THE DRAWINGS

Having thus generally described the nature of the present invention, the invention will now be further described, by way of a non-limitative example only, with reference to the accompanying drawings, in which.

In the following description of a preferred embodiment, like reference numbers refer to like parts.

DETAILED DESCRIPTION OF THE INVENTION

Figure 1:
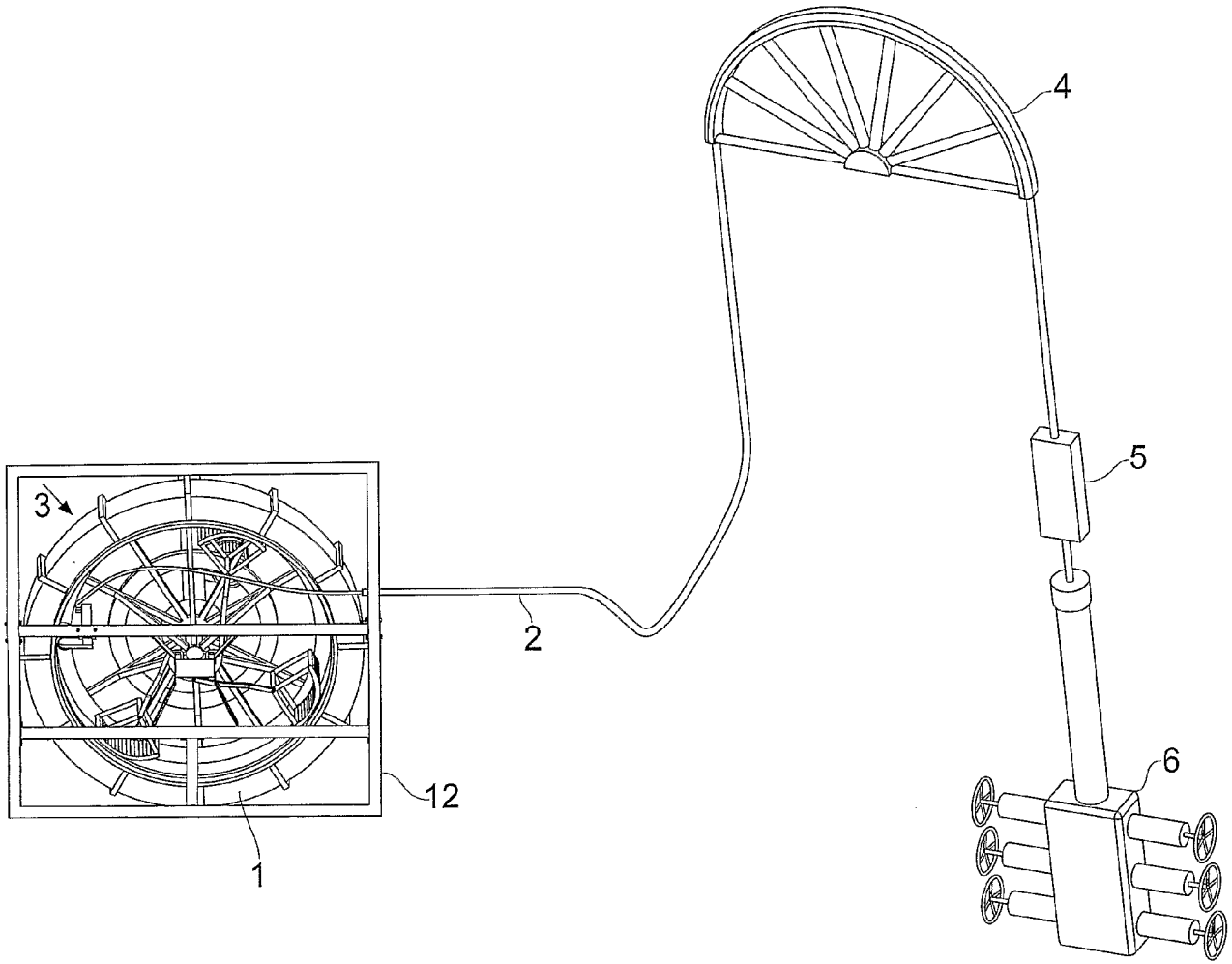
FIG. 1 is a perspective view of coiled tubing being injected into a well in order to perform well intervention operations.

FIG. 1 shows the main components of a cable reel assembly according to the present invention, where the assembly can be located on a floating structure offshore or a platform onshore. A cable spool 1 containing a continuous composite cable 22 is mounted on a stand 3. The continuous composite cable 22 is guided from the cable spool 1 and over a radius controller 4 and further towards an injector device 5 that is mounted over a wellhead 6. The radius controller may for instance be a gooseneck or a wheel. In order to protect the continuous composite cable 22, the continuous composite tubing 22 is guided through an outer flexible protecting tube 2, where the outer flexible tube 2 is mounted in the stand 3 and extends from the stand 3, over the radius controller 4 and into the injector device 5. The protecting tube 2 will thereby prevent the continuous cable 2 to be bent, it will further prevent fluid and oil spill etc.

The outer flexible protecting tube 2 may be manufactured as a whole tube or it may be manufactured with a slit extending over the entire length of the protecting tube 2.

The injector device 5 may be mounted on an elevated platform (not shown) above the wellhead 6, or it may also be mounted directly on top of the wellhead 6.

A drive system (not shown) in the reel assembly will together with the injector device 5 will then be able to run the continuous composite tubing 22 into and out of well bores.

The continuous composite tubing 22 is a composite cable, where a combined resinous-fibrous outer tube encompasses Teflon insulated conductors/fibres.

Figure 2:
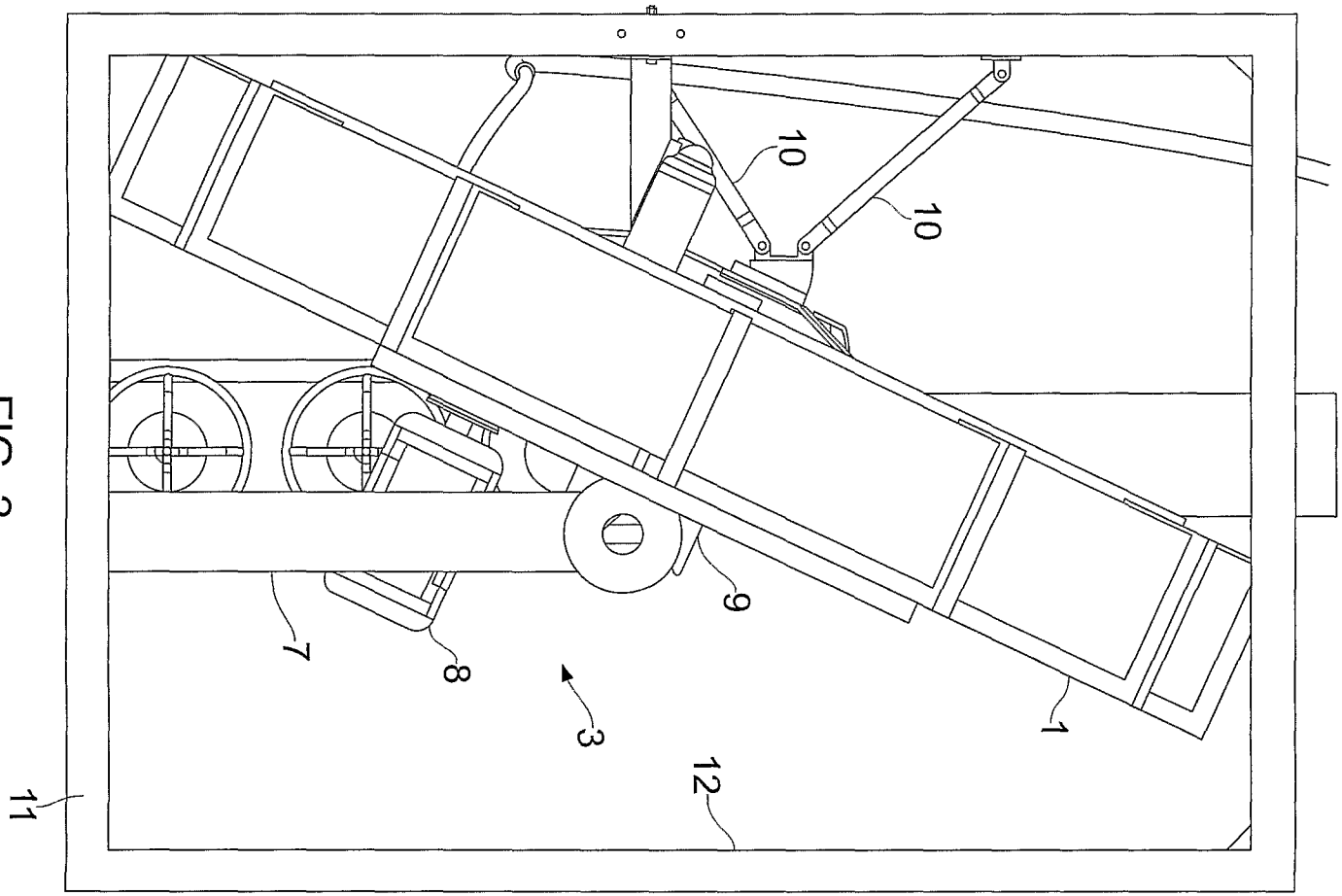
FIG. 2 is a perspective view of a reel assembly, including a spool arranged within a stand.

Referring now to FIG. 2, the cable reel assembly comprises a cable spool 1, onto which spool 1 the continuous composite cable is wound. The cable spool 1 is operatively mounted on the stand 3. The stand includes legs 7 which support a drive unit 8 and a central support member 9 through which the cable spool 1 rotates around (not visible). The drive unit 8 imparts rotational power to the cable spool 1. The stand 3 is mounted on a pair of skids 11 so that it can be easily transported. A removable cage frame 12 protects the cable spool 1 and the stand 3 and is mounted to the skids 11. At least one hydraulic cylinder 10 connects the cable spool 1 and the cage frame 12, such that the cable spool 1 can be adjusted and tilted. A swivel connection 13 is arranged to connect the continuous composite tubing 22 to a fluid source or drain (not shown).

The central support member 9 (see also FIG. 3) extends along the axis of the cable spool 1.

Figure 3:
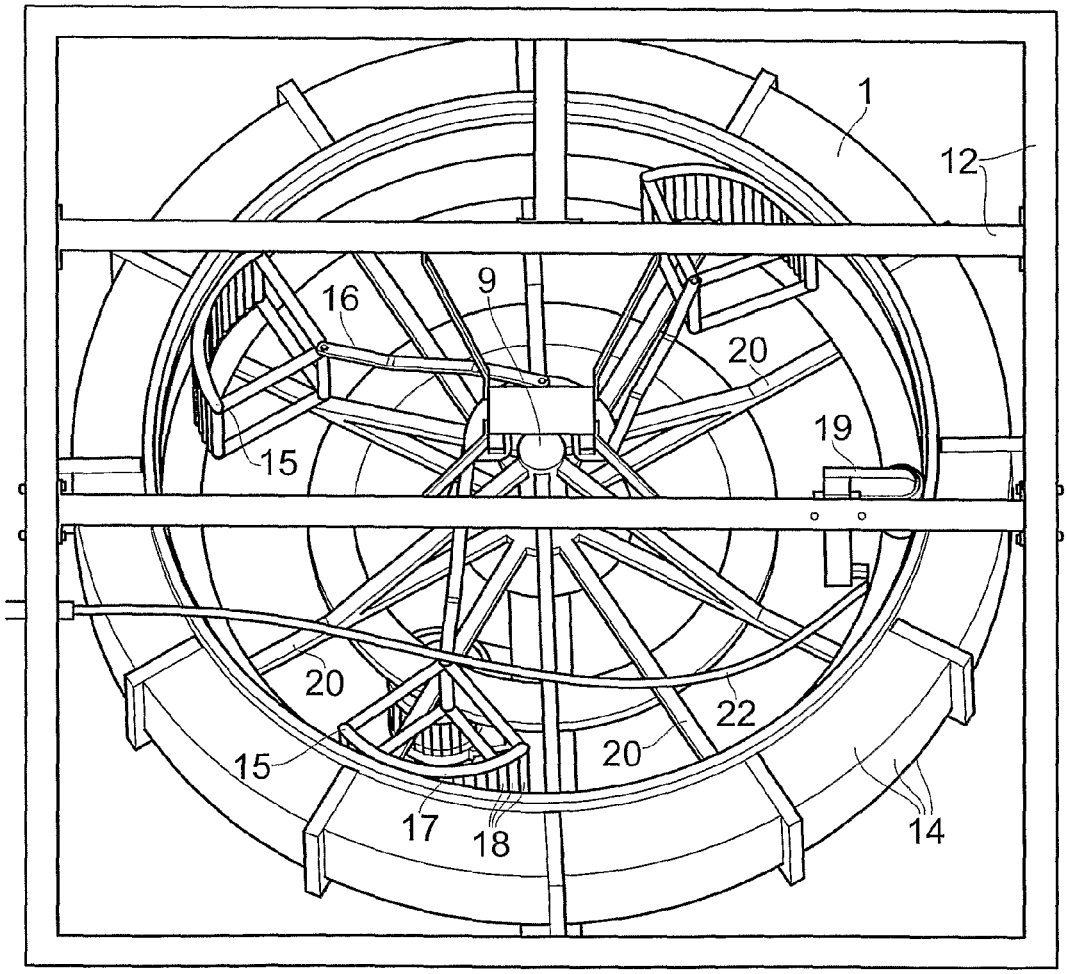
FIG. 3 is a perspective view of the reel assembly, showing in greater detail the spooling of a continuous cable.

It can be seen from FIG. 3 that the continuous composite tubing 22 is wound inside the cable spool 1, as a U-formed housing 14 is arranged around the outer periphery of the cable spool 1. The U-formed housing 14 is connected to radial support members 20, where the radial support members on their opposite sides are connected to the central support member 9. The U-formed housing 14 is formed of a back wall that extends along the axis of the spool 1, and two flanges that are arranged perpendicular on the back wall, thereby forming the U-shaped housing. In order to hold and control the continuous composite tubing 22 in position when winding or unwinding the composite tubing 22, at least three cable support devices 15 are arranged inside the cable spool 1. These cable support devices comprise arms 16 that on one side are mounted to the central support member 9, and on their opposite side are mounted to gooseneck 17 provided with rollers 18. The goosenecks can pivot around their connections to the arms 16. Furthermore, a tubing guidance device 19 is mounted to the central support member 9, in order to obtain a correct spooling of the continuous cable 2. The tubing guidance device 19 is controllable so that the composite tubing 22 is laid across the cable spool 1 in a neat and organized fashion.

The foregoing description is made in reference to exemplary embodiments of the invention. However, the embodiments may be modified or altered without departing from the scope of the invention, which scope is defined and limited solely by the appended claims.

The invention claimed is:

1. A reel assembly for supporting a stiff continuous cable (22) for oilfield service operations, wherein the reel assembly comprises a portable stand (3) with a central support member (9) for supporting a spool (1), said spool (1) being arranged to be driven by a drive unit (8), wherein the reel assembly further comprises cable support devices (15), each cable support device (15) comprising an arm (16), one side of said arm (16) being mounted to said central support member (9) and an opposite side of said arm (16) being pivotally connected to a gooseneck (17) provided with rollers (18), the cable support devices (15) being arranged inside said spool (1), radial support members (20) extending from said central support member (9), and a tubing guidance device (19) extending from said central support member (9) and a U-shaped inwardly facing housing (14) being connected to ends of said radial support members (20), the U-shaped inwardly facing housing (14) being formed of a back wall that extends along the axis of said spool (1) and two flanges that are arranged perpendicular on said back wall, said tubing guidance device (19) being controllable in order to lay said continuous cable (22) in an organized way inside said U-shaped inwardly facing housing (14).

2. The reel assembly according to claim 1, wherein said portable stand (3) being connected to a cage frame (12), said spool (1) being arranged tilted within the cage frame (12).

3. The reel assembly according to claim 2, wherein a protection tube (2) arranged for guiding and protecting said cable (22) is mounted to said removable cage frame (12).

4. The reel assembly according to claim 1, wherein said removable cage frame (12) is removable from said spool (1) and stand (3).

5. The reel assembly according to claim 1, wherein said tubing guidance device (19) being controllable.

6. The reel assembly according to claim 1, wherein at least one hydraulic cylinder (10) connects said cable spool 1 and cage frame (12), so as for said spool (1) to be adjusted and tilted.

7. The reel assembly according to claim 1, wherein said drive unit (8) is provided with a gear arrangement.

* * * * *